United States Patent [19]

Todd

[11] Patent Number: 4,537,257

[45] Date of Patent: Aug. 27, 1985

[54] SUBMERSIBLE PUMP

[75] Inventor: David B. Todd, Calgary, Canada

[73] Assignee: Shell Oil Company, Houston, Tex.

[21] Appl. No.: 590,312

[22] Filed: Mar. 16, 1984

[51] Int. Cl.[3] ..... E21B 43/00

[52] U.S. Cl. ..... 166/369; 166/387; 166/106; 166/115

[58] Field of Search ..... 166/105, 106, 114, 115, 166/369, 372, 387

[56] References Cited

U.S. PATENT DOCUMENTS

| | | | |
|---|---|---|---|
| 2,903,066 | 9/1959 | Brown | 166/115 |
| 2,911,048 | 11/1959 | Publin, III et al. | 166/115 |
| 3,460,626 | 8/1969 | Ehrlich | 166/115 |
| 3,986,552 | 10/1976 | Scott | 166/369 |
| 4,237,976 | 12/1980 | Wilson | 166/369 |
| 4,320,800 | 3/1982 | Upchurch | 166/106 |
| 4,425,965 | 1/1984 | Bayh, III et al. | 166/106 |
| 4,440,221 | 4/1984 | Taylor et al. | 166/106 |
| 4,440,231 | 4/1984 | Martin | 166/106 |
| 4,457,367 | 7/1984 | Brandell | 166/106 |

*Primary Examiner*—James A. Leppink
*Assistant Examiner*—William P. Neuder

[57] ABSTRACT

A method and apparatus for using a submersible pump to lift reservoir fluids in a well while having the tubing-/casing annulus isolated from the produced fluids. The apparatus allows the submersible pump to be positioned above the annular packoff device. The apparatus comprises an outer shield that encloses the pump and can be attached to the production tubing. The lower end of the shield attaches to a short tubing section that seals with the annular packoff device or a receptacle above the annular packoff device.

6 Claims, 4 Drawing Figures

SUBMERSIBLE PUMP

BACKGROUND OF THE INVENTION

The present invention relates to pumps used for the production of undergound reservoir fluids, in particular to electric submersible pumps used in the production of reservoir fluids such as crude oils.

An electric driven submersible pump used for the production of crude oil normally comprises an electric motor at the bottom of the apparatus and a multiple stage centrifugal pump at the top. The suction inlet for the pump is normally located about the mid-point of the overall apparatus and the discharge is at the top apparatus. This permits the pump to be attached to the normal production tubing string and lowered into the well together with the electric cable for transmitting power to the motor. As the pump is lowered, cable is strapped to the production tubing string. Operations are designed to minimize tubing manipulation to reduce the risk of cable damage. In wells that are producing relatively sweet crude oils, or other non-corrosive fluids this system works satisfactorily. In many cases, the production tubing/production casing annulus is used to vent solution gas which is produced along with crude oils. In the case of wells that contain sour crudes or other fluids (i.e., $CO_2$) that are corrosive, steps must be taken to protect the pump and the casing in the well. The normal procedure is to provide a packer above the pump so as to isolate the well fluids from the annulus between the casing and tubing. While this is a possible solution, it does involve considerable difficulty, since the electrical conductors must be passed through the packer and some means must be provided for seating and unseating the packer in the well.

Attempts to utilize this system are normally dependent on hydraulically set packers which can be set and released by hydraulic pressure or other packers which do not require tubing rotation for setting or releasing. While this is a possible solution, these type of packers normally are difficult to unseat and remove from wells producing corrosive fluids. Thus, when it is necessary to remove the pump from the well for servicing, considerable difficulty is involved in trying to unseat the packer and retrieve it so that the pump can be removed.

SUMMARY OF THE INVENTION

The present invention solves the above problems by providing an outer shell surrounding the submersible pump and motor. The bottom of the shell is provided with a short tubing section which can attach to standard subsurface equipment, for example, a hydraulic packer. This allows the submersible pump to be set above an annular packoff device to isolate the well casing from production fluid, and permits the tubing and pump to be detached from the packoff device. Various packoff devices may be used including devices requiring rotation for setup. Examples of suitable packers are permanent packers and retrievable packers. Permanent packers may be used in which case the short tubing section on the bottom of the pump enclosure would be attached to a seal assembly which seals in the bore of the permanent packer. Alternatively, a retrievable packer (which should not require tubing weight or tension to remain set because removal of the pump may release the packer) may be used in conjunction with a seal receptacle located above the packer. In this case, the short tubing section on the bottom of the pump enclosure would carry a seal section which would seal in the receptacle. A seal receptacle, which is an integral part of the casing string, may be used. In this case, the tubing section below the pump enclosure would carry a seal assembly which would attach to the seal receptacle of the casing string.

The shell has sufficient strength to withstand the formation fluid pressure although it is maintained as thin as possible so that the size of the submersible pump is not unduly restricted. Preferably, the shell is formed of a corrosion resistant material, for example, stainless steel or similar materials, so that corrosion concerns are minimized. With a single string of production tubing, isolating the annulus necessitates all solution gas to be produced through the pump and up the tubing. Where such gas production may interfere with pump operation it will be desirable to include means for venting the gas before the pump, or for bypassing the gas around the pump.

BRIEF DESCRIPTION OF THE DRAWINGS

The present invention will be more easily understood from the following description when taken in conjunction with the attached drawings.

FIGS. *2A–2C* shows three possible arrangements for use of the submersible pump unit according to the present invention.

DESCRIPTION OF PREFERRED EMBODIMENTS

Figure 1:
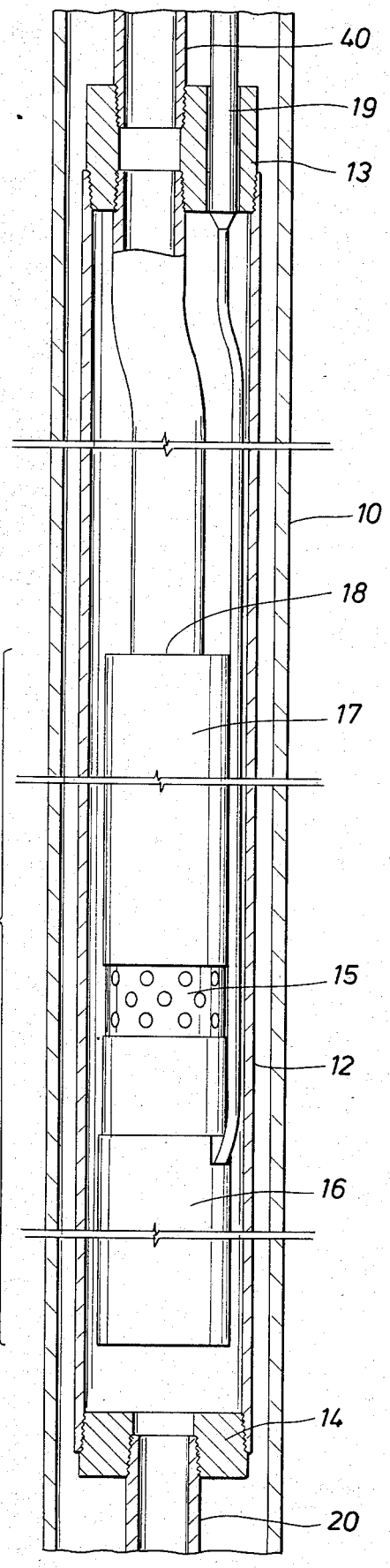
FIG. 1 shows an elevation view in section of a submersible pump unit constructed according to the present invention.

Referring to FIG. 1, there is shown a well having production casing 10 installed therein. A submersible pump assembly 11 is positioned inside the cylindrical shield 12 and the complete assembly is lowered into the well on the production tubing string 40. The submersible pump assembly 11 comprises a motor section 16 on the bottom and a pump section 17 located on the top. Intermediate between the two sections is the suction inlet 15 for the pump which discharges through the outlet 18 at the top. As shown, the production tubing string 40 threads into the end cap 13 which is used to close the top of the shield 12. The outlet 18 should be connected to the end cap 13 by suitable means and communicate with the production tubing string. The electrical cable 19 passes through the end cap 13 and down along the pump section 17 and connects with the motor section 16.

The lower end of the shield is closed by a lower end cap 14 which threads into the shield. A short production tubing string 20 is threaded into the end cap which can be attached to any wellbore equipment required to effect a seal between the production tubing and production casing. Referring to FIG. 2, there are shown three wells with casing 10 installed therein. The submersible pump assembly 11 is enclosed in the shield 12 and lowered into the well on production tubing 40. Threaded into the lower end cap 14 of the shield 12 is a section of production tubing 20 which attaches to conventional subsurface well equipment.

Figure 2A:
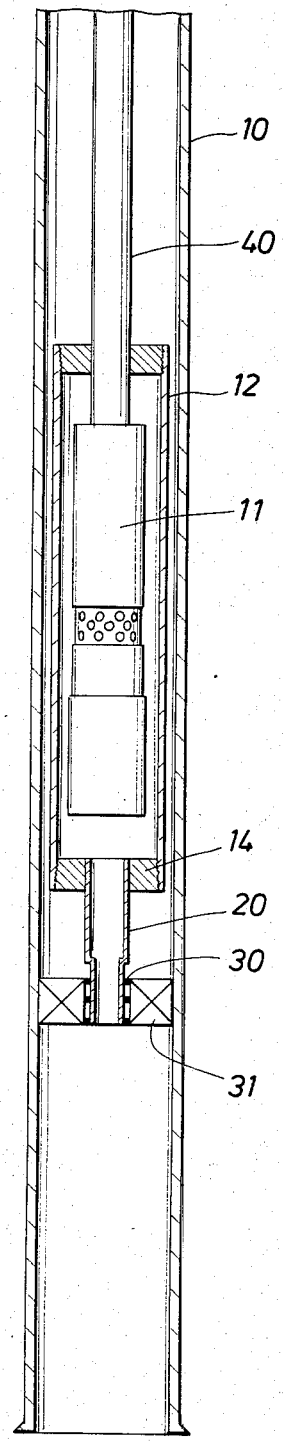
Figure 2B:
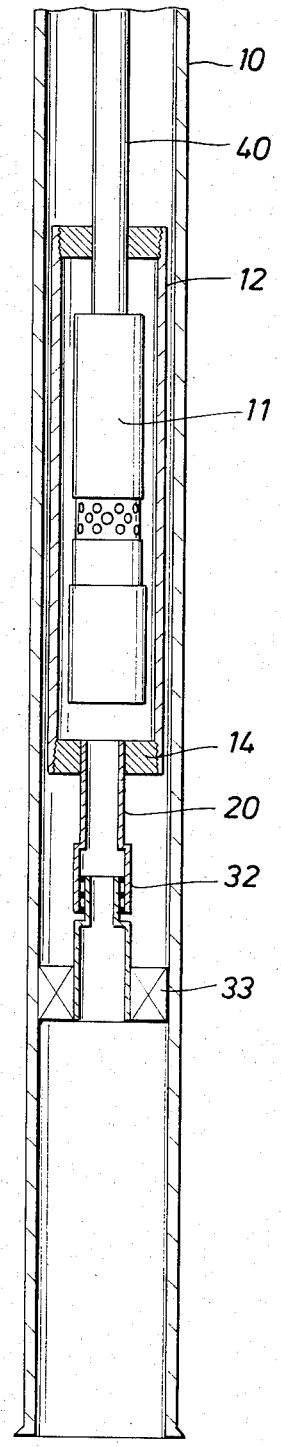

FIG. 2A shows the lower production tubing 20 attached to a seal assembly 30 which seals inside the seal bore of a permanent type packer 31. FIG. 2B shows the lower production tubing 20 attached to a seal receptacle 32 which is attached to a retrievable type packer 33.

Figure 2C:
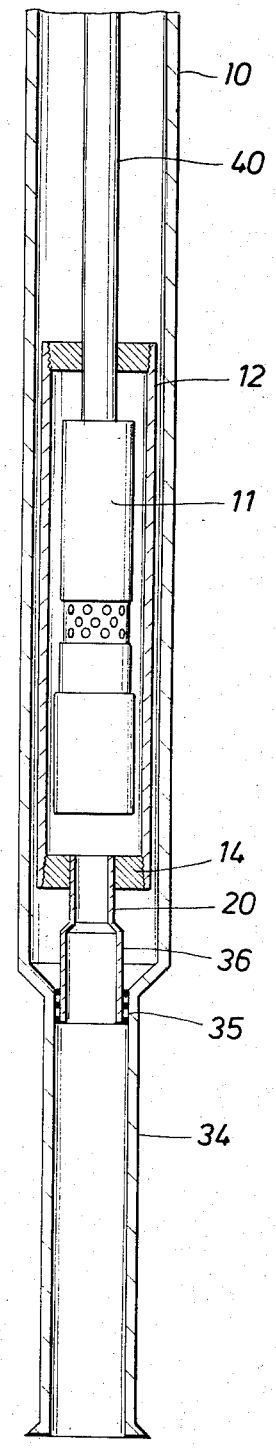

The packer may be of any type as long as it does not require tubing weight or tension to remain set. FIG. 2C shows a well with tapered casing. The lower taper of the casing 34 has a polish bore receptacle 35. The lower production tubing 20 is attached to a seal assembly 36 which seals in the polish bore receptacle 35.

From the above description it will be appreciated that the produced fluids are isolated from the tubing/casing annulus. This is accomplished in such a manner that fluids are allowed to flow freely into the pump section and the operation of the pump is unaffected by the shield so that the tubing, pump assembly, and shield assembly can be removed from the well, for example for maintenance, without having to release a packer.

Dimensions of the shield and end caps can be easily modified to fit different pump and casing sizes.

Material selection for the shield assembly will be dependent on produced fluid composition and other well characteristics.

What is claimed is:

1. A method for isolating a well casing from the fluids in a well being produced by a submersible pump, said method comprising:

enclosing and sealing the submersible pump in a cylindrical shell;

attaching the top of the cylindrical shell to the production tubing string;

attaching a packer to the lower end of a tubing section projecting from the lower end of the cylindrical shell;

lowering the pump and production tubing into the well; and seating said packer to seal the annular space between the well casing and the cylindrical shell.

2. The method of claim 1 wherein said packer is first run and set and then the enclosed pump and production tubing are run in the well with the lower end of the tubing section projecting through said packer.

3. The method of claim 2 wherein said packer is set by hydraulic pressure.

4. The method of claim 2 wherein said enclosed pump is removed from the well and the packer remains in the well.

5. An apparatus for producing hydrocarbon fluids containing corrosive fluids from a well using a submersible pump having suction and discharge openings while isolating the well casing from the fluids, said apparatus comprising:

a cylindrical shield member having closed ends, said submersible pump being disposed in said cylindrical shield with means for fluid communication between the lower closed end of the shield and the suction opening of the pump;

a production tubing string, said tubing string being secured to the other of the closed ends of the shield member;

a short tubing section, said short tubing section being secured to the lower closed end of the shield member; and a hydraulically setable packer, said packer being attached to said short tubing string, whereby said packer when set will close the annular space between said short tubing string and said well casing.

6. The apparatus of claim 5 wherein said other end of the shield member has a pass-through connection for the electrical power supply for said pump.

* * * * *